US007066504B2

(12) United States Patent
Perkins

(10) Patent No.: US 7,066,504 B2
(45) Date of Patent: Jun. 27, 2006

(54) SLAM LATCH AND STRIKE ASSEMBLY

(75) Inventor: Frederick M. Perkins, Ft. Lauderdale, FL (US)

(73) Assignee: Perko, Inc., Miami, FL (US)

( * ) Notice: Subject to any disclaimer, the term of this patent is extended or adjusted under 35 U.S.C. 154(b) by 122 days.

(21) Appl. No.: 10/697,154

(22) Filed: Oct. 31, 2003

(65) Prior Publication Data

US 2005/0093307 A1 May 5, 2005

(51) Int. Cl.
*E05C 19/00* (2006.01)

(52) U.S. Cl. ..... 292/300; 292/160; 292/173; 292/DIG. 11; 292/DIG. 31; 70/208

(58) Field of Classification Search ..... 292/300, 292/32, 39, 142, 152, 160, 172, 147, 279, 292/341.18, DIG. 11, DIG. 31; 70/208
See application file for complete search history.

(56) References Cited

U.S. PATENT DOCUMENTS 372,645 A 11/1887 Tweeddale
448,108 A * 3/1891 Ayers ..... 292/172
462,183 A * 10/1891 Varney ..... 292/280
476,050 A * 5/1892 King ..... 292/39
477,654 A * 6/1892 Grimes ..... 292/261
517,512 A * 4/1894 Angus ..... 292/63
812,476 A * 2/1906 Becker ..... 292/271
850,840 A * 4/1907 Ledford ..... 292/346
913,410 A 2/1909 Marbach
1,390,519 A * 9/1921 Evans ..... 292/341.18
1,439,078 A * 12/1922 Evans ..... 292/341.18
1,588,899 A * 6/1926 McCarthy ..... 292/172
1,604,540 A * 10/1926 Taggart, Jr. ..... 292/173
1,636,069 A * 7/1927 Perry ..... 292/172
1,817,241 A * 8/1931 Dewbery ..... 292/39
2,398,336 A * 4/1946 Udall ..... 292/172
2,404,670 A * 7/1946 Udall et al. ..... 292/172
2,934,370 A * 4/1960 Love et al. ..... 292/142
3,514,979 A * 6/1970 Wiesmann ..... 70/81
3,825,289 A * 7/1974 Armstrong ..... 292/163
4,136,540 A * 1/1979 Coralli et al. ..... 70/100
4,991,888 A * 2/1991 Cinnamond ..... 292/296
5,046,340 A * 9/1991 Weinerman et al. ..... 70/208
5,280,881 A * 1/1994 Karmin ..... 70/279.1
5,301,989 A * 4/1994 Dallmann et al. ..... 292/142
5,346,266 A 9/1994 Bisbing
5,413,391 A * 5/1995 Clavin et al. ..... 292/170

(Continued)

*Primary Examiner*—Brian E. Glessner
*Assistant Examiner*—Carlos Lugo
(74) *Attorney, Agent, or Firm*—Lawrence E. Laubscher, Sr.; Lawrence E. Laubscher, Jr.

(57) ABSTRACT

A slam latch and strike assembly for latching together a pair of generally parallel relatively laterally displaceable support members, including a body adapted for connection with one of the support members, a latch member mounted for axial displacement between extended and retracted positions in a transverse opening contained in the body member, a spring biasing the latch member toward the extended position, and a strike member mounted on the other support member adjacent the free end of the latch member when the latch member is in the extended position, the strike and latch members carrying sets of strike teeth and latch teeth that are normally in engagement when the latch is in its extended position, the tips and valleys of the teeth of at least one of the latch and strike teeth sets having curved and convex transverse profiles, thereby to compensate for minor misalignment between the strike and latch members.

10 Claims, 6 Drawing Sheets

U.S. PATENT DOCUMENTS 5,484,178 A * 1/1996 Sandhu et al. ..... 292/173
5,609,373 A * 3/1997 Gromotka ..... 292/229
5,715,631 A * 2/1998 Kailian et al. ..... 49/450
5,775,746 A * 7/1998 Charlton ..... 292/219
5,992,908 A * 11/1999 Yared et al. ..... 292/196
6,109,669 A * 8/2000 Pinkow ..... 292/175
6,113,160 A 9/2000 Johansson
6,530,250 B1 * 3/2003 Linares et al. ..... 70/208
6,575,503 B1 6/2003 Johansson
6,709,030 B1 3/2004 Furlong
6,877,782 B1 * 4/2005 Magnusson ..... 292/170

* cited by examiner

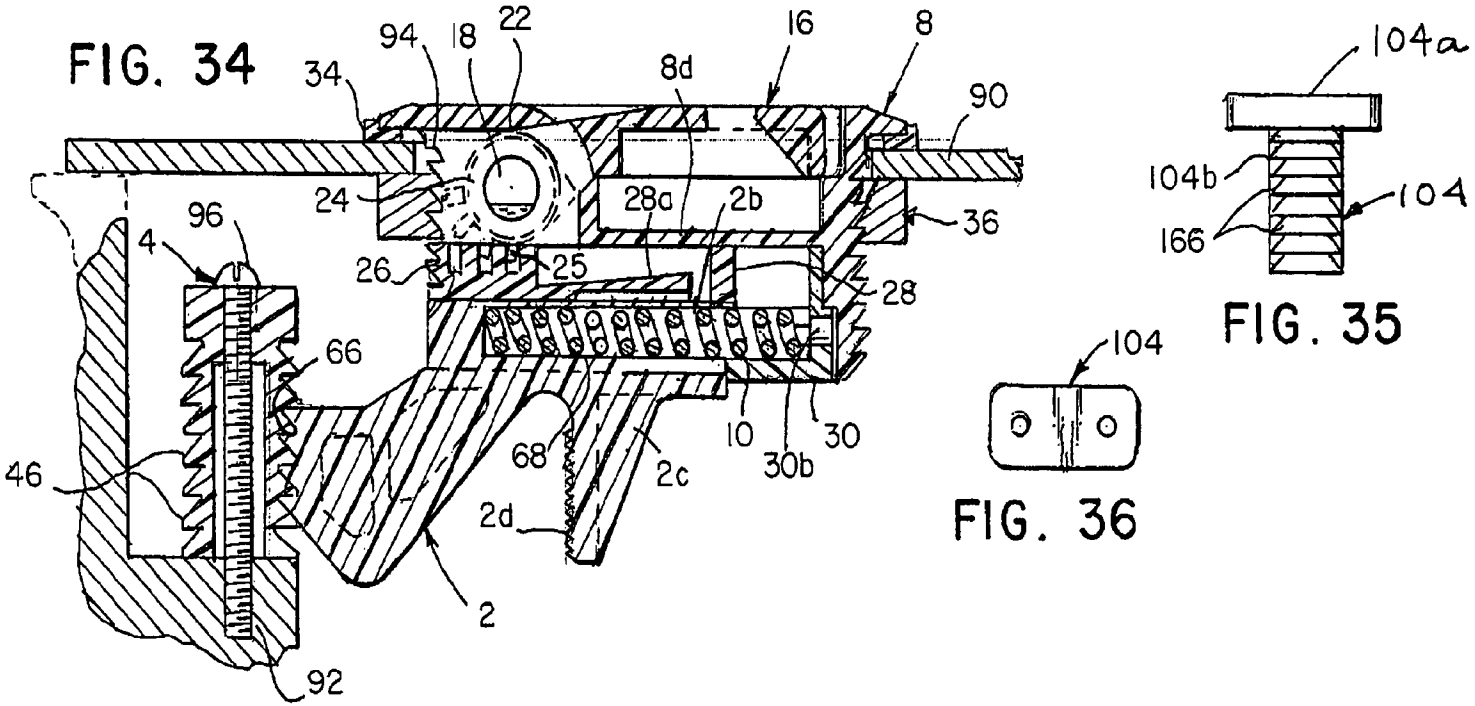
FIG. 34
FIG. 35
FIG. 36
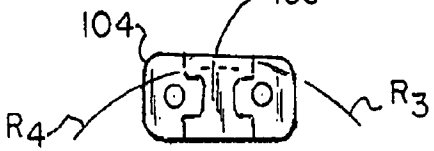
FIG. 37
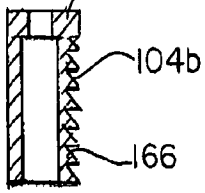
FIG. 39
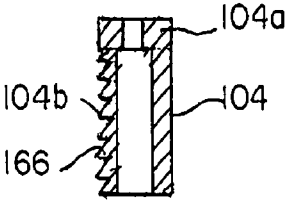
FIG. 38

SLAM LATCH AND STRIKE ASSEMBLY

FIELD OF THE INVENTION

A slam latch and strike assembly is provided for latching together a pair of adjacent generally parallel relatively laterally displaceable support members, including a body adapted for connection with one of the support members, a latch member mounted for axial displacement between extended and retracted positions in a transverse opening contained in the body member, a spring biasing the latch member toward the extended position, and a strike member mounted on the other support member adjacent the free end of the latch member when the latch member is in the extended position, the strike and latch members carrying ratcheting sets of strike teeth and latch teeth that are normally in engagement when the latch is in its extended position, the tips and valleys of the teeth of at least one of the latch and strike teeth sets being curved and convex, thereby to compensate for minor misalignment between the strike and latch members.

BACKGROUND OF THE INVENTION

Brief Description of the Prior Art

It is well known in the patented prior art to provide latch means for releasably connecting together a pair of laterally movable members, such as the hatch of a ship. Examples of such known latches are set forth in the patents to Tweeddale U.S. Pat. No. 372,645, Murbach U.S. Pat. No. 913,410, Bisbina U.S. Pat. No. 5,346,266, and Johansson, et al., U.S. Pat. Nos. 6,113,160 and 6,575,503, among others. As is known in the art, the ratcheting latch teeth and the strike teeth of slam latch arrangements include linear transverse tips and valleys that are parallel with each other.

One problem experienced in the use of such latches is the difficulty in maintaining proper alignment between the latch and strike members, particularly when the support members are subjected to stress and distortion, such as occurs on marine vessels, aircraft, travel homes, and the like. Another problem is providing a reliable latch assembly that is leak-proof during adverse conditions of weather and use.

The present invention was developed to avoid the misalignment and other drawbacks of the known latch and strike assemblies, and to provide a positive-acting waterproof latch assembly that is reliable and relatively inexpensive to produce.

SUMMARY OF THE INVENTION

Accordingly, it is a primary object of the present invention to provide a latch and strike arrangement wherein the tips and valleys of at least one of the sets of the ratcheting latch teeth and the strike teeth are curved and supported by a convex surface, thereby to correct for minor misalignment between the latch and strike members. In a first embodiment, the strike has a circular cross-section, while in a second embodiment, the strike has a generally rectangular, polygonal or H-shaped cross-section.

According to a more specific object of the invention, the latch member is spring-biased outwardly toward an extended latched position relative to the body in which it is mounted, and handle means connected with the body operate rack and pinion means to axially displace the latch toward its retracted unlatched position. Furthermore, finger operable safety means are provided on the latch for engagement from within the chamber for manually displacing the latch member against the spring biasing force toward the retracted unlatched position, thereby to permit opening of the hatch from within the hold or chamber.

According to another object of the invention, the latch is mounted for displacement displaceable in a tubular body that has an intermediate divider wall and a removable bottom wall, thereby to afford access to the latch and the operating components therefor. Seal means are provided on the operating handle pivot shaft for sealing latch assembly against leakage. A sealing gasket is also provided concentrically about the latch body. Preferably the components of the latch assembly, including the latch body, the strike, the latch and the handle, are formed from a suitable corrosion-resistant synthetic plastic material. A simple single nut arrangement is provided for mounting the externally threaded body within an opening contained in the associated support member.

BRIEF DESCRIPTION OF THE DRAWINGS

Other objects and advantages of the invention will become apparent from a study of the following specification when viewed in the light of the accompanying drawings, in which:

FIG. 18 is a sectional view taken along line 19—19 of FIG. 17;

FIGS. 23 and 24 are elevational and end views, respectively, of the pivot shaft of FIG. 2;

FIG. 33 is a sectional view taken along line 33—33 of FIG. 31;

FIG. 34 is a sectional view illustrating the cooperation between the latch member of FIG. 27 and the round strike member of FIG. 10 for latching together a pair of laterally displaceable support members;

FIG. 35 is an elevational view of a rectangular second strike embodiment of the invention, FIGS. 36 and 37 are top and bottom views of the strike embodiment of FIG. 35, and FIGS. 38 and 39 are a right and left hand views, respectively, of the strike member of FIG. 35.

DETAILED DESCRIPTION

Figure 2:
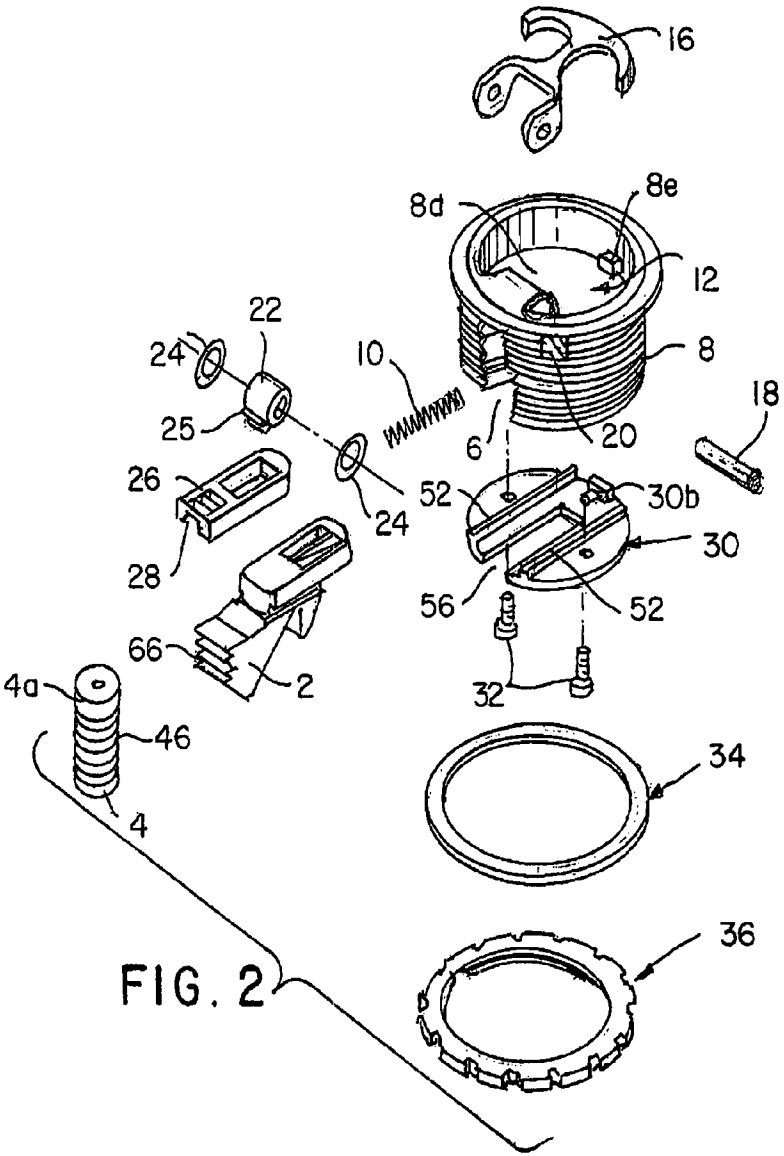
FIG. 2 is an exploded perspective view of the embodiment of FIG. 1.
Figure 1:
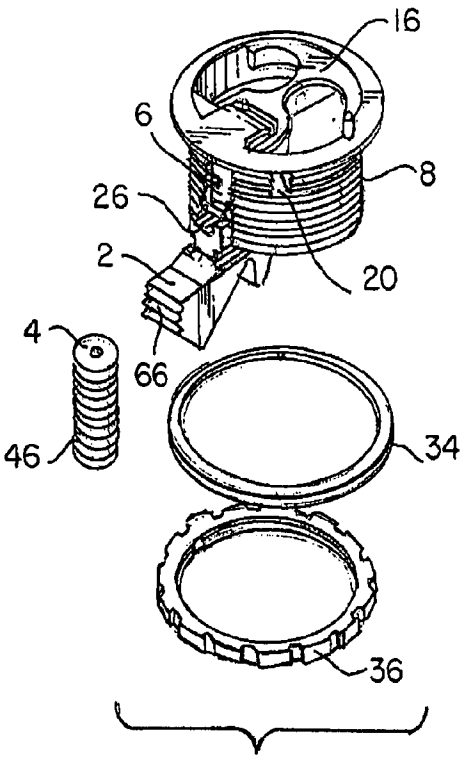
FIG. 1 is a perspective view of a first embodiment of the latch and strike assembly of the present invention.

Referring first more particularly to FIGS. 1 and 2, the slam latch and strike assembly of the present invention includes a latch member 2 that is operable to engage a vertical strike member 4, thereby to latch together a pair of support members as will be described below in connection with FIG. 34. The latch member 2 is mounted for horizontal sliding displacement within a notch 6 contained in the bottom end of a tubular body 8 below the horizontal intermediate divider wall portion 8*d*. A compression spring 10 biases the latch member 2 from a retracted position within the central chamber 12 of the body 8 toward the extended position illustrated in FIG. 1. A handle 16 is pivotally connected with the body 8 by means of a pivot shaft 18 that extends through corresponding openings 20 contained in the body 8. The pivot shaft 18 has a non-circular cross-sectional configuration upon which is concentrically and non-rotatably mounted the pinion gear 22. Resilient O-ring seals 24 are provided on the shaft 18 at either end of the pinion gear 22, thereby to seal the upper portion of the assembly above the intermediate divider wall 8*d*. The teeth 25 of the pinion gear 22 engage corresponding teeth 26 of rack 28 that is connected for sliding movement in one direction relative to the latch 2. A bottom plate 30 is removably connected with thc bottom end of the body 8 by means of screws 32. and annular gasket 34 and lock nut 36 are adapted to be mounted concentrically about the body 8 as will be discussed in greater detail below.

Figure 4:
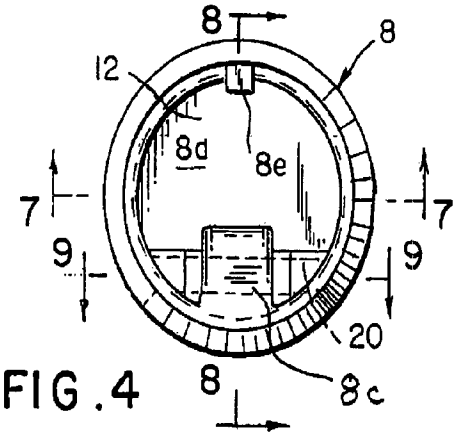
Figure 3:
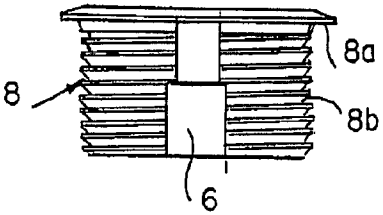
FIG. 3 is a front elevational view of the body of FIGS. 1 and 2, and FIGS. 4 and 5 are top and bottom views of the body of FIG. 3.
Figure 8:
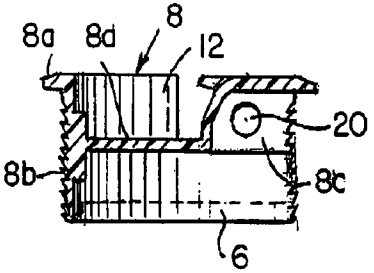
FIGS. 7, 8, and 9 are sectional views taken along the lines 7—7, 8—8, and 9—9 of FIG. 4, respectively.
Figure 7:
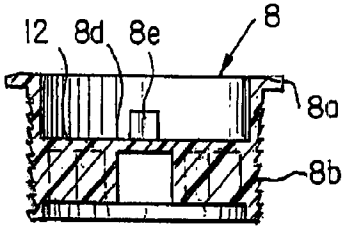
Figure 6:
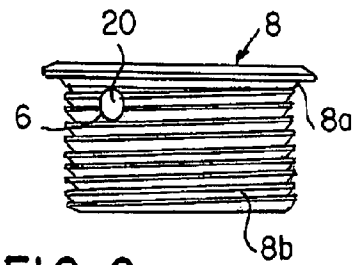
FIG. 6 is a right hand view of the body of FIG. 3.
Figure 9:
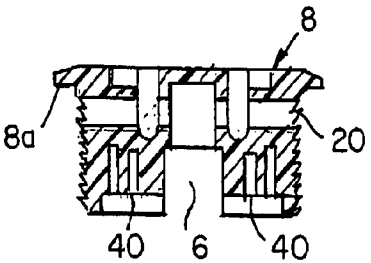

Referring now to FIGS. 3–9, the body member 8 is of generally tubular construction and includes an annular outwardly directed upper flange portion 8*a*, an externally threaded tubular wall portion 8*b*, and an internally enlarged portion 8*c* in the chamber 12 defined above the divider wall portion 8*d*. The lower end of the wall portion 8*b* contains the vertical notch 6 that receives the latch member 2 of FIG. 2. As best shown in FIGS. 4, 8, and 9, the transverse bore 20 that receives the pivot shaft 18 extends through the enlarged body portion 8*c* contained within the body 8. Handle stop portion Se is provided within upper chamber 12 adjacent the intermediate wall 8*d*.

Figure 5:
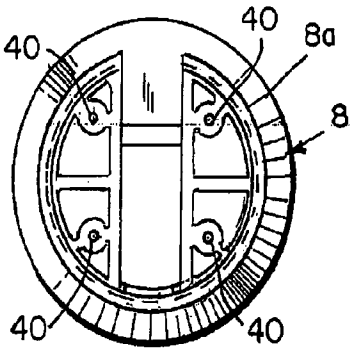

As shown in FIG. 5, the bottom portion of the body 8 contains a plurality of threaded holes 40 for receiving the screws 32 that mount the bottom plate 30 upon the bottom of the housing 8, as will be described in greater detail below.

Figure 12:
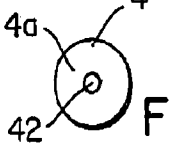
FIG. 12 is a top plan view of the circular strike member of FIG. 10.
Figure 11:
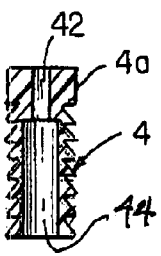
FIG. 11 is a sectional view taken along line 11—11 of FIG. 10.
Figure 10:
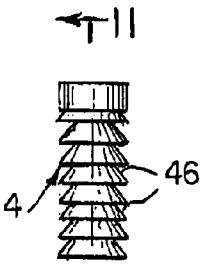
FIG. 10 is an elevational view of the circular strike member of FIGS. 1 and 2.
Figure 11A:
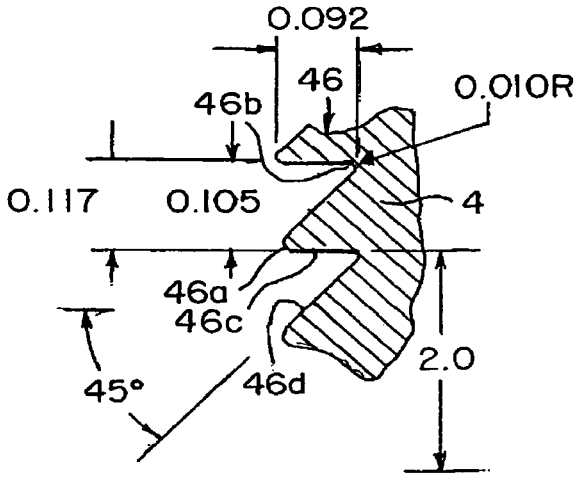
FIG. 11*a* is a detailed view of the strike teeth.
Figure 13:
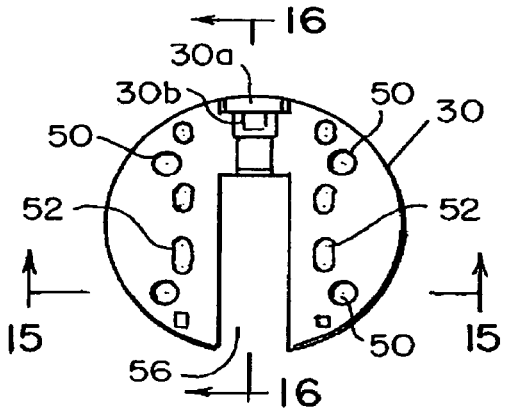
FIGS. 13 and 14 are top and bottom views of the bottom plate of FIG. 2, and FIGS. 15 and 16 are sectional views taken along lines 15—15 and 16—16 of FIG. 13, respectively.
Figure 14:
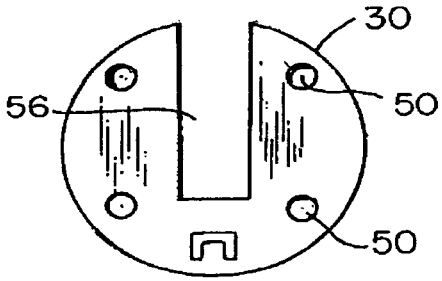
Figure 15:
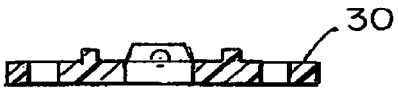
Figure 16:
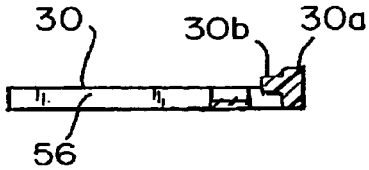

Referring now to FIGS. 10–12, the first strike embodiment 4 has a circular cross-sectional configuration and is provided at its upper end with a round head portion 4*a* that contains a through bore 42, the opposite end of the strike being counterbored to define the counter bore 44. In accoedance with a characterizing feature of the present invention, the circular strike 4 is provided with a series of vertically-spaced strike teeth 46. As best shown in FIG. 11*a*, the strike teeth have transversely-extending tip portions 46*a* and valley portions 46*b* that are contained in vertically spaced horizontal planes, respectively, and are curved, since they are on the concentric outer surfaces of the strike member 4. The ratcheting configuration of the strike teeth is such that the flat portion 46*c* is generally horizontal, and the angular portion 46*d* extends at an angle of about 45 degrees relative to the horizontal tooth portion 46*c*.

Referring now to FIGS. 13–16, the bottom plate 30 is provided with the through openings 50 that receive the screw means 32, thereby to fasten the bottom plate to the bottom of the body 8. On its upper surface, the bottom plate is provided a pair of parallel guide means 52 that serve to guide the latch member 2 during its displacement between its extended end retracted positions. The latch member 2 is contained within a slot 56 that extends diametrically partially across the bottom plate 30. A spring support portion 30*a* having a spring support pin 30*b* is provided for supporting one end of the compression spring 10 As shown in FIG. 34, the other end of the compression spring 10 reacts with the latch member 2 to bias the same toward its outwardly extended position relative to the body 8.

Figure 17:
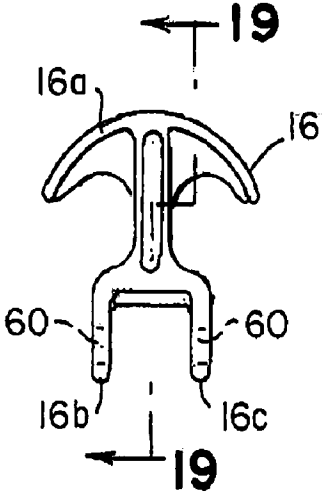
FIG. 17 is a front elevational view of a handle member of FIG. 2.
Figure 18:
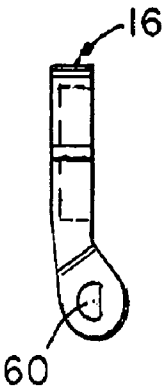
FIG. 18 is a left hand view of the handle member of FIG. 17.
Figure 19:
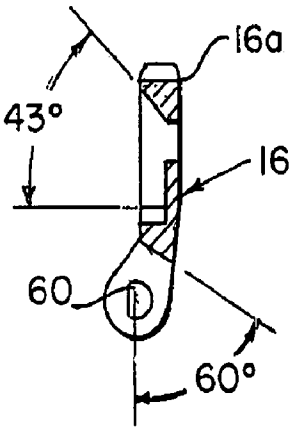
Figure 20:
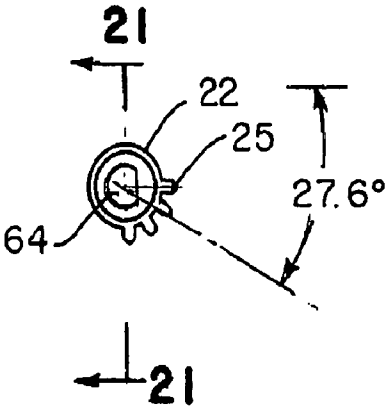
FIG. 20 is a left hand end view of the pinion gear of FIG. 2.
Figure 22:
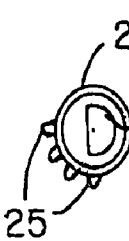
Figure 21:
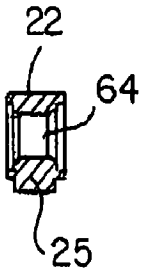
FIG. 21 is a sectional view taken along line 21—21 of FIG. 20.
Figure 23:
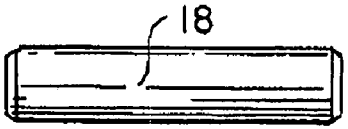
FIG. 23 is a right hand view of the pinion gear.
Figure 24:
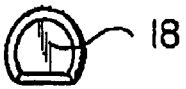
Figure 26:
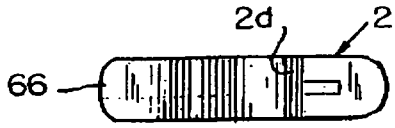
FIGS. 25 and 26 are top and bottom views of the latch member of FIG. 2.

Referring now to FIGS. 17–19, the handle 16 includes a handle portion 16*a* at one end, and a bifurcated leg portion at its other end defining a pair of legs 16*b* 16*c* that contain a pair of noncircular aligned openings 60, respectively. The openings 60 are adapted to receive the corresponding ends of the pivot pin 18 which, as shown in FIGS. 23 and 24, has a noncircular configuration corresponding to that of the openings 60. Mounted concentrically in nonrotational relation on the pivot shaft 18 is the pinion gear 22 having pinion teeth 62, as shown in FIGS. 20–22. The cross-sectional configuration of the bore 64 extending through the pinion 22 corresponds with that of the pivot shaft 18, whereby the pinion gear is non-rotatably mounted on the pivot shaft.

Figure 27:
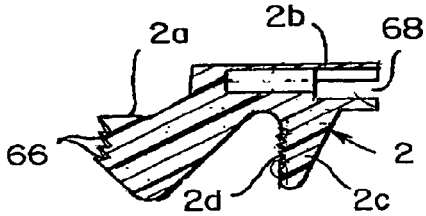
FIG. 27 is a sectional view taken along line 27—27 of FIG. 25.
Figure 28:
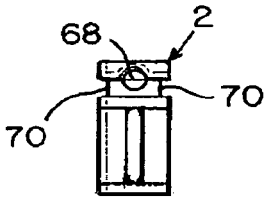
FIGS. 28 and 29 are right hand end and left hand elevational views, respectively, of the latch member.
Figure 30:
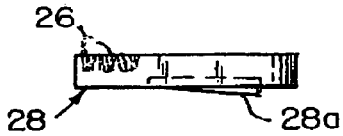
FIGS. 30–33 are side elevation, top, and bottom views, respectively, of the rack of FIG. 2.
Figure 29:
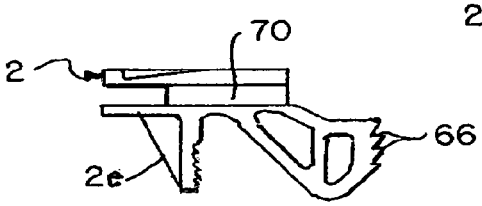
Figure 31:
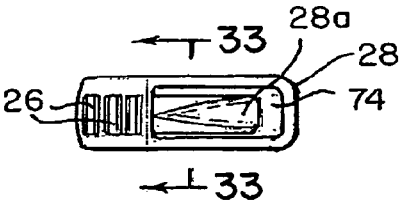
Figure 32:
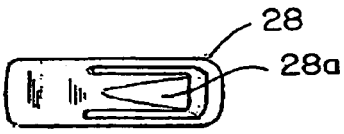

Referring now to FIGS. 25–29, the latch member 2 includes at one end a latch portion 2*a* provided with a series of vertically arranged ratcheting latch teeth 66 the configuration of which corresponds with the strike teeth 46 of FIG. 11*a*. At its other end, the latch is provided with a projecting portion 2*b* that extends horizontally in spaced relation above the finger grip portion 2*c* of the latch, as best shown in FIG. 27. The right hand end of the latch member is provided with a recess 68 for receiving the other end of the compression spring 10. At each side, the latch is provided with guide grooves 70 that slidably receive the edges of the slot 56 defined in the bottom plate 30. The upper side surfaces of the latch are guided between the guide means 52 on the bottom plate, thereby to accurately guide the latch for displacement relative to the slot 6 contained in the body 8. The finger-operable release portion 2*c* is provided with a roughed roughened surface 2*d* for manual displacement of the latch toward the released position by an operator within the space defined by the support members, as will be described below.

Figure 33:
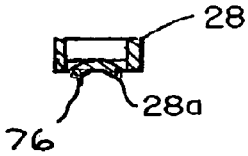

Referring now to FIGS. 30–33, the rack member 28 provided with the rack teeth 26 is of general rectangular configuration, and includes an opening 74 that receives the resilient tongue portion 28*a* which has a downwardly directed concave surface, as best shown in FIG. 33. The lateral wings 76 of the tongue portion 28*a* are adapted for insertion within corresponding spaces 80 defined on opposite sides of the latch projecting portion 2*b*, as shown in FIGS. 25 and 34, thereby to afford limited longitudinal displacement of the latch relative to the rack member 28.

Referring now to FIG. 34, the slam latch means of the present invention is utilized to fasten together a pair of generally parallel relatively laterally moveable support members 90 and 92. Thus, the body member 8 is mounted within a hole 94 that is formed in the first support member 90, the flange portion 8*a* being seated on the gasket 34 seated the upper surface of the support member 90. The lock washer 36 is threadably cormected with the externally threaded outer surface of the body 8 to compress the gasket 34 against the upper surface of the first support member 90. When the latch member 66 is in its illustrated extended position of FIG. 34, the latch teeth 66 engage the strike teeth 46 on the strike member 4 that is rigidly connected with the second support member 92 by screw 96. In accordance with a safety feature of the invention, the latch member 2 may be manually displaced axially to the right toward the disengaged position relative to the strike member 4 manually by engagement of the finger portion 2*c*. Alternatively, the latch may be displaced toward the disengaged position by raising the handle 16 to simultaneously rotate the pinion gear 22, thereby to displace rack 25 and latch 2 to the right toward their disengaged positions. The latch member 2, of course, is displaceable to the right toward the disengaged retracted position against the biasing force of spring 10 until the end extremity of the wing 76 engages the stop surfaces 2*e* on the projecting portion 2*b* of the latch member 2. The first support member 90 generally has a thickness of about ⅛" to about ¾", and the diameter of the opening 94 is about 2".

Figure 25:
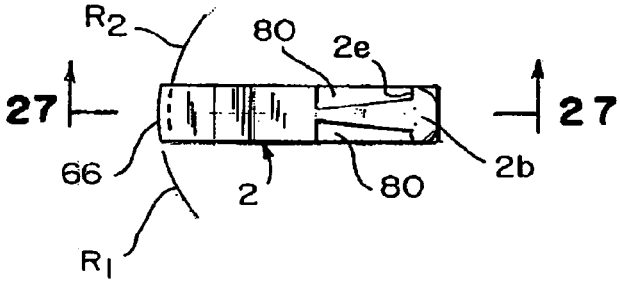

As shown in FIG. 25, in accordance with a characterizing feature of the present invention, the transverse end surfaces of the peaks and valleys of the latch teeth 66 are convex and curved in an arcuate manner in their respective horizontal planes. Thus, the tips of the latch teeth 66 are curved by the radius $R_1$ and the valleys of the latch teeth are curved about the radius $R_2$. Thus, the curved arcuate latch teeth 66 cooperate with the correspondingly curved circular teeth 46 on the strike 4, thereby to compensate for minor misalignment between the latch and the strike, in accordance with a major advantage of the present invention.

Referring to now FIGS. 35–38, instead of a round strike member 4 shown in FIGS. 10–12, the strike member 104 have a generally rectangular cross-sectional configuration with a rectangular top portion 104*a*. In this case, the lateral face 104*b* of the strike member 104 that is adjacent the latch member 2 is convex, and the latch strike teeth 166 have tips and valleys that are curved by the radii $R_3$ and $R_4$, respectively. The configuration of the latch teeth 66 of FIG. 27 and the strike teeth 166 of FIG. 38 correspond with the configuration of the strike teeth 46, as shown in FIG. 11*a*. Thus, the ratcheting strike and latch teeth have a one-way longitudinal cross-sectional configuration, thereby to define a slam latch that permits the first support member 90 to be displaced laterally toward the coplanar position with the second support 92 as shown in FIG. 34, but displacement of the first support member 90 in the opposite direction is prevented by the one-way configuration of the strike teeth and the latch teeth. Thus, to open the first support member 90, the latch 2 must be displaced to the right in FIG. 34 either manually by operation of the finger grip 2*d*, or by operating the release lever 16 to pivot the pinion 22 to cooperate with rack 26 and thereby displace latch 2 to its retracted position against the biasing force of compression spring 10.

The O-ring seals 24 concentrically mounted on the shaft at opposite ends of the pinion gear serve to seal the portion of the latch mem\mechanism above the divider wall portion 8*d*, thereby to seal the portion of the slot 6 contained below the divider wall, as shown in FIG. 8. Preferably, the body 8, end plate 30, handle 16, rack 28, latch 2 and strike 4 are formed of a suitable corrosion-resistant synthetic plastic material. The pinion gear may similarly be formed of the synthetic plastic material, or a non-corrosive metal material, such as brass.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. A slam latch and strike assembly for releasably connecting together two adjacent support members that are relatively displaceable between a generally planar closed position and a relatively laterally displaced open position, comprising:

(a) a generally tubular body adapted for connection with a first one of said support members, said body having a vertical longitudinal axis and a horizontal divider wall defining upper and lower chambers in said body, said body having at its lower end a wall portion containing a transverse opening communicating with said lower chamber;

(b) a latch member mounted in said wall opening for axial displacement between retracted and extended positions relative to said body, said latch member including a first end portion that extends from said housing when said latch member is in said extended position;

(c) spring means biasing said latch member toward said extended position relative to said body;

(d) release means for displacing said latch toward said retracted position relative to said body, said release means comprising:

(1) a handle member arranged in said upper chamber above said divider wall;

(2) pivot means connecting said handle for pivotal movement relative to said tubular body, said pivot means including a pivot shaft extending trough at least one shaft opening in said tubular body;

(3) rack and pinion means arranged in said lower chamber below said divider wall, said rack and pinion means being operable by said pivot shaft to displace said latch member between its retracted and extended positions; and (4) seal means sealing said shaft opening; and (e) a strike member adapted for connection with a second one of said support members at a location adjacent said latch first end when said latch member is in said extended position, said strike member having a longitudinal axis generally parallel with said body longitudinal axis;

(f) said latch member first end portion and said strike member having adjacent generally parallel surfaces each provided with a series of cooperating ratcheting latch teeth and strike teeth, respectively, (1) said latch teeth and said strike teeth being in engagement when said latch is in said extended position and said support members are in said relatively closed position;

(2) the ratcheting configuration of said latch teeth and said strike teeth being such as to permit movement of said support members toward said closed position, but to prevent movement of said support members toward said open position;

(3) said latch teeth and said strike teeth, when in the engaged condition, having transverse tips contained in vertically spaced horizontal planes, respectively, all of said tips of said latch teeth being curved and convex, thereby to compensate for slight misalignment between said latch and strike members.

2. A slam latch and strike assembly as defined in claim 1, wherein said strike member is cylindrical and has a circular cross-sectional configuration, the tips of said strike teeth being circular, said strike member containing a longitudinal bore for receiving a fastening member.

3. A slam latch and strike assembly as defined in claim 1, wherein said strike member has a generally polygonal cross-sectional configuration, and the tips of said strike teeth are arcuate and convex.

4. A slam latch and strike assembly for releasably connecting together two adjacent support members that are relatively displaceable between a generally planar closed position and a relatively laterally displaced open position, comprising:

(a) a generally tubular body adapted for connection with a first one of said support members, said body having a vertical longitudinal axis and a horizontal divider wall defining upper and lower chambers in said body, said body having at its lower end a wall portion containing a transverse opening communicating with said lower chamber;

(b) a latch member mounted in said wail opening for axial displacement between retracted and extended positions relative to said body, said latch member including a first end portion that extends from said housing when said latch member is in said extended position;

(c) spring means biasing said latch member toward said extended position relative to said body;

(d) release means for displacing said latch toward said retracted position relative to said body, said release means including;

(1) a release handle pivotally connected with said body for pivotal displacement about an axis normal to the plane that contains the longitudinal axes of said body and said latch member, said handle being displaceable between a locked position within said body upper chamber and a released position extending from said body chamber; and (2) rack and pinion gear means connecting said latch member with said handle for displacement between said extended and retracted positions relative to said body when said handle is in said locked and released positions, respectively;

(e) a strike member adapted for connection with a second one of said support members at a location adjacent said latch first end when said latch member is in said extended position, said strike member having a longitudinal axis generally parallel with said body longitudinal axis;

(f) said latch member first end portion and said strike member having adjacent generally parallel surfaces each provided with a series of cooperating ratcheting latch teeth and strike teeth, respectively, (1) said latch teeth and said strike teeth being in engagement when said latch is in said extended position and said support members are in said relatively closed position;

(2) the ratcheting configuration of said latch teeth and said strike teeth being such as to permit movement of said support members toward said closed position, but to prevent movement of said support members toward said open position;

(3) said latch teeth and said strike teeth, when in the engaged condition, having transverse tips contained in vertically spaced horizontal planes, respectively, all of said tips being curved and convex, thereby to compensate for slight misalignment between said latch and strike members;

(g) said body wall transverse opening comprising an axially extending slot contained in the bottom end of said body member; and further including an end plate connected with said body member to close said body member bottom end.

5. A slam latch and strike assembly as defined in claim 4, wherein said end plate contains guide means for guiding said latch member during the displacement thereof between said extended and retracted positions relative to said body member.

6. A slam latch and strike assembly as defined in claim 4, wherein the upper end of said body member includes an outwardly extending external annular flange portion adapted for seated engagement with the adjacent surface of the first support member when said body member is mounted in a corresponding opening contained therein, said body member being externally threaded; and further including:

(a) lock nut means threadably connected with said body member beneath the first support member, thereby to lock said body member to the first support member.

7. A slam latch and strike assembly as defined in claim 4, and further including a pivot shaft non-rotatably connected with said release handle, said rack and pinion means including a pinion gear non-rotatably connected with said pivot shaft for angular displacement with said release handle, and O-ring seal means mounted on said pivot shaft, thereby to seal the assembly against leakage.

8. A slam latch and strike assembly as defined in claim 6, and further including an annular gasket arranged concentrically about said body, said gasket being compressed between said body annular flange portion and the adjacent surface of the first support member.

9. A slam latch and strike assembly as defined in claim 4, and further wherein said rack and pinion means includes a rack member, said latch member being connected for sliding movement relative to said rack member in the retracted direction against the biasing force of said spring means.

10. A slam latch member as defined in claim 4, wherein said body, latch member, handle member, rack and strike are formed from a corrosion-resistant synthetic plastic material.

* * * * *